US006626022B1

(12) United States Patent
Stamm

(10) Patent No.: US 6,626,022 B1
(45) Date of Patent: Sep. 30, 2003

(54) DOUBLE ACTING METAL FORMING MACHINE, ESPECIALLY A FORGING MACHINE

(75) Inventor: Detlef Stamm, Bergisch-Gladbach (DE)

(73) Assignee: SMS Eumuco GmbH, Leverkusen (DE)

( * ) Notice: Subject to any disclaimer, the term of this patent is extended or adjusted under 35 U.S.C. 154(b) by 249 days.

(21) Appl. No.: 09/657,727

(22) Filed: Sep. 8, 2000

(30) Foreign Application Priority Data

Sep. 11, 1999 (DE) ..... 199 43 441

(51) Int. Cl.[7] ..... B21D 43/02; B21J 9/18
(52) U.S. Cl. ..... 72/450; 72/451; 72/417
(58) Field of Search ..... 72/442, 450, 451, 72/417, 350

(56) References Cited

U.S. PATENT DOCUMENTS 1,511,214 A * 10/1924 Beyer ..... 72/451
2,808,798 A * 10/1957 Georgeff ..... 72/417
2,947,273 A * 8/1960 Dehn et al. ..... 72/417
3,130,699 A * 4/1964 Ward ..... 72/417
3,433,048 A * 3/1969 Balunas, Jr. et al. ..... 72/451

FOREIGN PATENT DOCUMENTS

| | | |
|---|---|---|
| DE | 37 05 235 | 11/1988 |
| EP | 0 040 965 | 5/1980 |

* cited by examiner

*Primary Examiner*—David B. Jones
(74) *Attorney, Agent, or Firm*—Herbert Dubno

(57) ABSTRACT

A double-acting or single-acting mechanical forging press has an eccentric drive acting on the entire ram or an outer ram member and a toggle mechanism which acts on an inner ram, e.g. via removable pins so that, when the pins are removed, the toggle mechanism is decoupled from the inner ram member.

4 Claims, 2 Drawing Sheets

DOUBLE ACTING METAL FORMING MACHINE, ESPECIALLY A FORGING MACHINE

FIELD OF THE INVENTION

My present invention relates to a double-acting mechanical metal working machine, especially a forging machine, of the type in which an eccentric serves to drive a ram. More particularly, the invention relates to a metal forming machine, especially a forging press, having a combined eccentric and toggle drive for a ram which can be subdivided into an outer ram member and an inner ram member respectively acting on outer and inner tool parts.

BACKGROUND OF THE INVENTION

Forging presses utilizing eccentrics or toggle drive systems are described, for example, in DE 37 05 235 C2 and EP 0 040 965 A2. These systems, however, are generally suitable for single stage operations only. Double-acting metal working machines are, however, known but utilize generally a hydraulic pressure cushion for at least one of the tool actions. The drawback in such a system is that the magnitude of the hydraulic pressure is usually limited to the capacity of the pressure cushion and may not be able to exceed 5000 kN. In some cases, however, the press may have to overcome the hydraulic pressure and as a result there are energy and force losses in the operation of such presses. Furthermore, the press must be dimensioned to be capable of supporting excessive pressures.

Double-acting presses utilizing hydraulics have not been found to be fully effective with respect to the flow or plastic deformation of the metal, especially in the case of gear fabrication and have had disadvantages with respect to formation of burrs and the like in the forging of gears.

OBJECTS OF THE INVENTION

It is, therefore, the principal object of the present invention to provide an improved double-acting metal forming machine, especially a forging machine which is free from the drawbacks previously mentioned.

Another object of this invention is to provide an improved double-acting metal working machine which is especially suitable for the forging of gears without detrimental burrs and under more effective material-flow and plastic deformation conditions than has been possible heretofore.

It is yet another object of the invention to provide a versatile double-acting forging press which is of more economical construction and capable of more universal use for the shaping of metals than has heretofore been the case.

Yet another object of this invention is to provide an improved double-acting metal forming machine which can optionally be employed for a single acting tool or die system and which operates mechanically, i.e. without hydraulic ram actuation.

SUMMARY OF THE INVENTION

These objects and others which will become apparent hereinafter are attained, in accordance with the present invention, by providing a double-acting metal working machine, especially a forging press, having an outer ram member which can be driven by an eccentric drive and an inner drive member which is driven by a toggle drive or mechanism such that the eccentric shaft can drive the entire ram or only the outer ram member.

The toggle mechanism, which can be effective selectively to act upon an inner tool part when desired can alternatively be ineffective when the latter actuates the ram as a whole in the case in which double action upon the tool is not desired or in an initial stage when the toggle mechanism is to be subsequently effective on, for example, the inner tool part.

The double-acting system of the invention allows the eccentric drive to act upon the outer ram member and the crank mechanism on the inner ram member and hence upon the tool parts which are coupled to these ram members. In this case, the characteristics of the metal working machine can be varied as may be required since it is possible to operate without the effects of the toggle mechanism.

The press can thus operate either as a single stage eccentric press or as a two-stage or double-acting mechanical press.

Since the toggle mechanism does not play a role in the displacement of the ram as a whole, especially in the case of hot forging of a tool, this disadvantageously long contact times between the tool and the workpiece can be avoided. It may be noted that such excessive contact times in hot forming cannot be avoided if, for example, the toggle mechanism would be coupled to the outer tool part and the eccentric drive to the inner tool part. The invention is also particularly effective in cold working of metals and thus the universality of the machine of the invention is an important advantage.

The double-acting metal forming of the machine can, in particular, comprise:

- a machine frame;
- a ram displaceable on the frame and comprising an outer ram member and an inner ram member displaceable relative to the outer ram member;
- a shaping tool mountable in the frame and having an outer tool part positioned for actuation by the outer ram member and an optional inner tool part for displacement by the inner ram member;
- an eccentric drive on the frame coupled selectively with the ram or with the outer ram member for displacement of the ram with both the members or only the outer ram member to shape a workpiece in the tool; and
- a toggle drive on the frame coupled with the inner ram member for displacement thereof.

Advantageously, a plurality of pressure pins are receivable in the tool and are aligned with the inner ram member and with the inner tool part for coupling displacement of the inner ram member to the inner tool part. It has been found to be advantageous for the eccentric drive to include a crankshaft mounted on the frame above the ram and a plurality of connecting rods connecting eccentrics of the shaft with the outer ram member or members on opposite sides of the inner ram member.

The toggle drive can include a lever mounted on the shaft, and a toggle linkage including a pair of articulated links pivotally connected at opposite ends to the inner ram member and to the frame, the lever being pivotally connected to one of the links.

Metal forming machines with double-acting tools can be used with advantage for hot forming, semi-hot forming or cold forming. With conventional mechanical metal forming machines or presses utilizing the kinematics of the toggle mechanism and wherein that toggle mechanism acts upon an outer ram member, the significant drawback arises that at all steps the contact between the outer ram member, over its entire contact cross section, and the workpiece is maintained for a comparatively long time under the applied pressure.

When the metal work is carried out at high temperatures, like those used for hot forming, the pressure contact duration can so heat the tool that its life expectancy is greatly reduced. In fact, overheating can destroy the tool entirely. With the apparatus of the invention, this drawback does not arise. All of the parts of the tool associated with the outer ram member have the very limited pressure contact time associated with an eccentric drive, i.e. a brief contact duration and the shortest of the contact times which can arise in an eccentrically driven press.

In the double-acting mode of operation, the toggle mechanism acts on the closed tool very rapidly and does not maintain its action during the entire press stroke. Loss of energy or work is thus minimized.

The press of the invention permits replacement of the tool (die assembly) to allow the press to be converted from a double-acting press to a conventional eccentric press, i.e. a single stage press. In that case the toggle drive is decoupled from the tool. As a consequence, the press is universal for simple single action and-for double-acting metal working processes.

According to the invention, the toggle mechanism can be decoupled from the inner ram movement by removing the pressure pins which are interposed between the inner tool part and the inner ram member. In order to convert the press from a simple eccentric operation to the two-stage operation, the pressure pins, which are preferably angularly spaced from one another by 120°, need only be dropped in place in the tool cassette so that they are arranged loosely between an inner tool part and the inner ram member. Before the outer ram member performs its working stroke upon the outer tool part, the inner ram member advances the inner tool part via the pressure pins and thereby accelerates the inner tool part into engagement with the workpiece.

BRIEF DESCRIPTION OF THE DRAWING

The above and other objects, features, and advantages will become more readily apparent from the following description, reference being made to the accompanying drawing in which.

SPECIFIC DESCRIPTION

Figure 2:
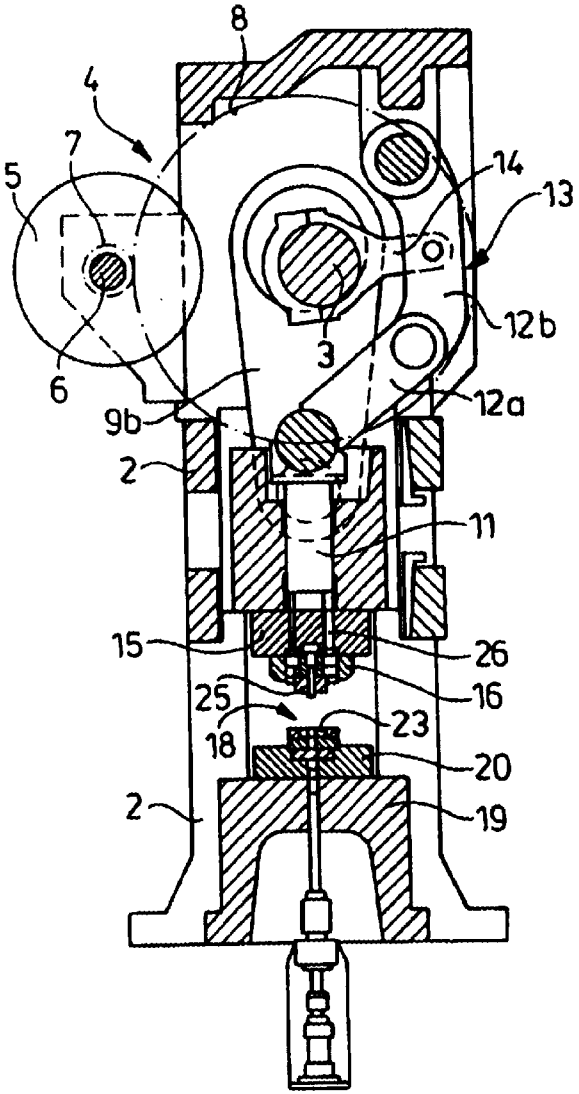
FIG. 2 is a cross section view of the machine of FIG. 1 in a plane perpendicular to the sectional plane of FIG. 1.
Figure 1:
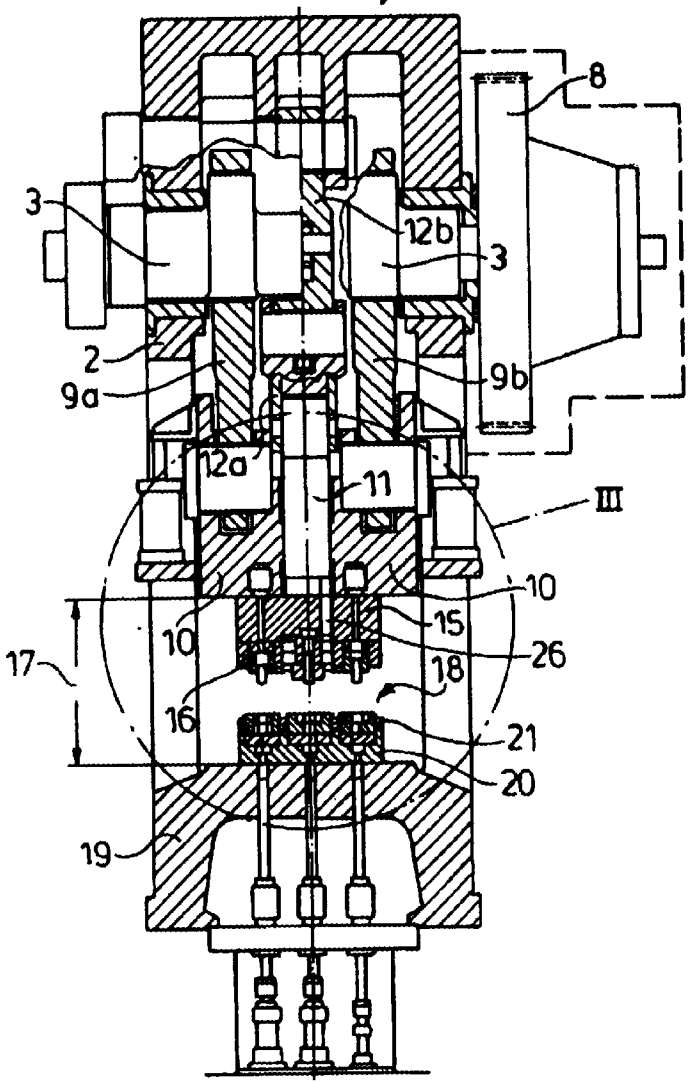
FIG. 1 is a longitudinal section of a double-acting mechanical metal working machine according to the invention and, in particular, a forging press for producing gears.
Figure 3:
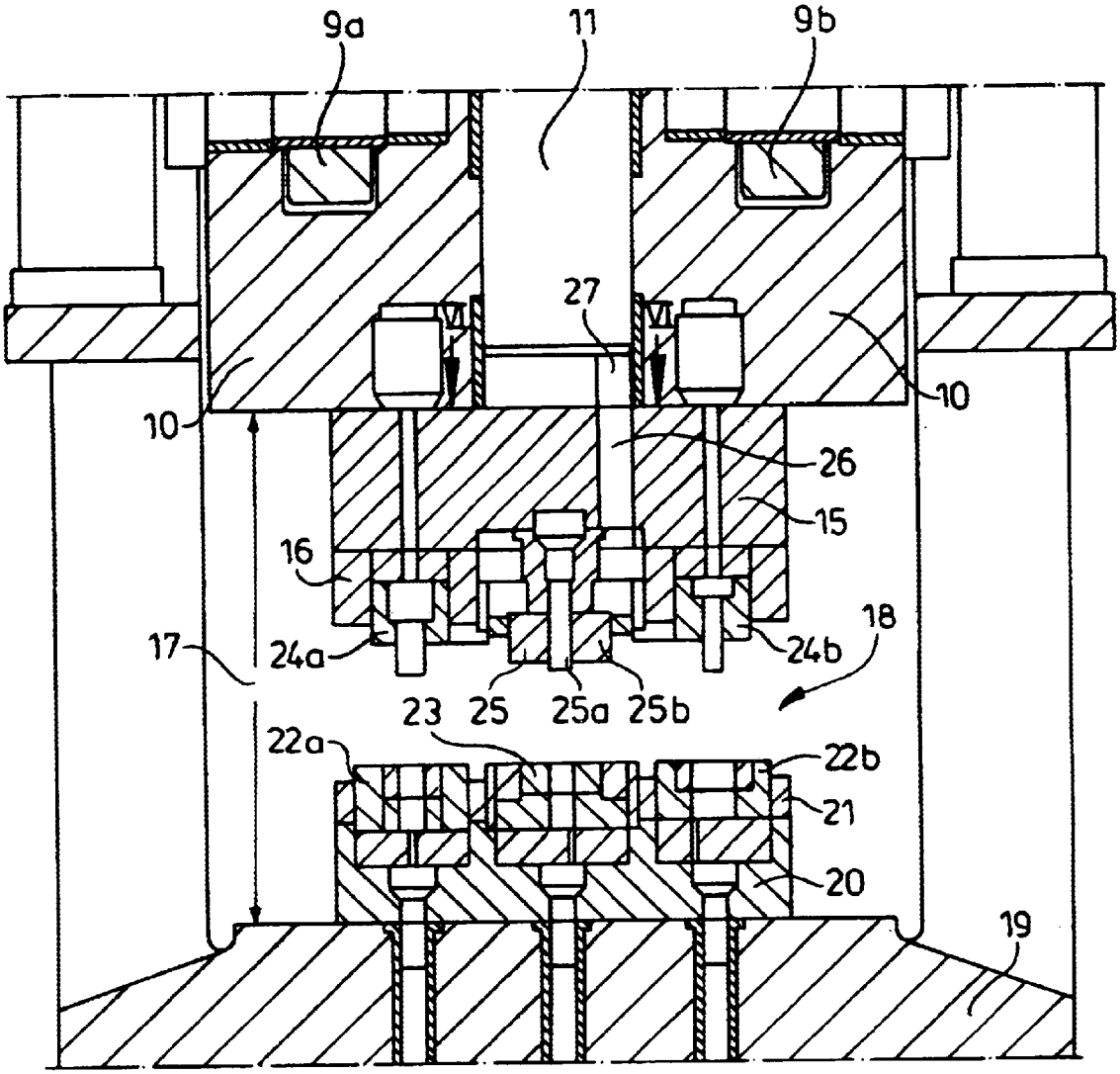
FIG. 3 is a detail of the region III of FIG. 1.
Figure 4:
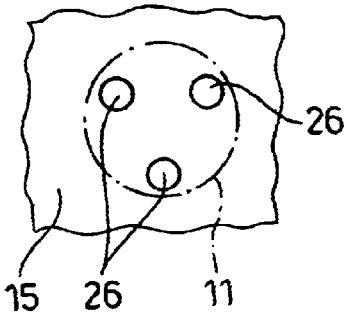
FIG. 4 us a section along the line IV—IV of FIG. 3.

The press 1 shown in FIG. 1 comprises a machine frame which, in its upper part 2 carries an eccentric shaft 3 of an eccentric drive 4. The eccentric drive 4, as can be seen from FIG. 2, comprises an electric motor 5 which drives a backshaft 6 having a pinion 7 meshing with a large diameter gear 8 on the shaft 3.

On the eccentric of the crankshaft, connecting rods 9*a* and 9*b* are journaled and these rods 9*a* and 9*b* are pivotally connected to an outer ram member 10.

Between the parts of the outer ram member 10 and the rods 9*a* and 9*b*, an inner ram member 11 is disposed. This inner ram member 11 is pivotally connected to one of the two articulated links 12*a*, 12*b* of a toggle mechanism or drive 13. The latter is driven, in turn, by a lever 14 affixed on the crank shaft 3 and pivotally connected to the upper link 12*b*, which, in turn, is pivotally connected to the upper frame member 2.

A tool assembly 16 is flanged via an intermediate plate 15 onto the outer ram member 10 and the inner ram member 11. The tool includes a lower die 18 mounted in the tool region 17 of the press and seated on the press cable or lower frame member 19 of the press via an intermediate plate 20. The lower tool cassette is represented at 21 and is stationary during operation of the press.

The upper and lower tool cassettes are here configured to forge workpieces into gears. The outer dies of the lower cassette are represented at 22*a* and 22*b* and the die of the lower assembly is represented at 23.

The complementary outer dies of the upper cassette 16 are shown at 24*a* and 24*b* while the complementary inner die of the upper cassette at 25. This inner die part 25 can be actuated independently of the outer die parts 24*a* and 24*b* in the cassette 16.

Via the drive 4, the outer ram member 10 is displaced by the eccentric drive. The inner ram member 11 is actuated by the toggle 13 in the double-acting mode of operation. The effect of the toggle mechanism can be decoupled from the tool by simply removing the three pressure pins 26 from the intermediate plate 15. All stages of the die then operate together as a single action eccentric press. The outer steps into the tool (24*a*, 24*b*) like the central step 25 are then driven by the eccentric and the step 25 is entrained by the plate 15 toward the workpiece. When, however, a double-acting operation is desired, the pins 26 are inserted into the plate 15 and the action upon the outer tool parts 24*a* and 24*b* remains exchanged. The tool 25 is subdivided into a stamper 25*a* and a closing die part 25*b* which is closed with the tool 16. The movement by the toggle mechanism of the pins 26 causes the inner ram member 11 to engage the free ends 27 of these pins and to operate the die closure 25*b*. The latter, in the downward stroke is accelerated relative to the stamper 25*a*. When the upper die member 25b reaches its lower dead point against the lower die member, the toggle mechanism via the pins 26 maintains a closing force while the outer ram member with steps 24*a* and 24*b* and the layer 25*a*, are brought into their lower dead point. In the central workpiece is plasmically deformed in a previously closed die by the double action.

The pressure contact lines of the outer tool burrs (24, 25 and 22*a* and 22*b* is brief as is the pressure contact time of the stamper 25*a*. The die part 25*b* and the intermediate and the inner tool 23 have a longer contact but lower pressure during this contact as brought up by the toggle action. The two stage operation ensures plastic flow of the workpiece readily and burr-free shaping.

The press 1 of the invention is suitable for all kinds of metal working processes, i.e. double-acting or single acting operations and tools without requiring any extensive modification of the press.

The two stage operation merely requires replacement of the tool cassette and the substitution of one previously provided with the pressure pins.

I claim:

1. A double-acting metal forming machine comprising:

a machine frame;

a ram displaceable on said frame and comprising an outer ram member and an inner ram member displaceable relative to said outer ram member;

a shaping tool mountable in said frame and having an outer tool part positioned for actuation by said outer ram member and an inner tool part for displacement by said inner ram member;

an eccentric drive on said frame coupled with said outer ram member for displacement of said outer ram member to shape a workpiece in said tool in a first operational state of said eccentric drive;

a toggle drive on said frame coupled with said inner ram member for displacement thereof independently of displacement of said outer ram member; and pressure means receivable in said tool and aligned with said inner ram member and with said inner tool Part for coupling said inner ram member to said inner tool part, said eccentric drive being constructed and arranged to displace both of said ram members in a second operational state of said eccentric drive.

2. The double-acting metal forming machine defined in claim 1 wherein said eccentric drive comprises a crankshaft mounted on said frame above said ram and plurality of connecting rods connecting eccentrics of said shaft with said outer ram member on opposite sides of said inner ram member, said pressure means being a plurality of pressure pins.

3. The double-acting metal forming machine defined in claim 2 wherein said toggle drive includes a lever mounted on said shaft, and a toggle linkage including a pair of articulated links pivotally connected at opposite ends to said inner ram member and to said frame, said lever being pivotally connected to one of said links.

4. The double-acting metal forming machine defined in claim 3 constituting a drop forging machine.

* * * * *